United States Patent [19]

Crowther

[11] 3,951,449

[45] Apr. 20, 1976

[54] DUAL BAR STOOL SYSTEM

[76] Inventor: Hearl L. Crowther, 1755 Orange Ave., Suite F, Costa Mesa, Calif. 92627

[22] Filed: Jan. 30, 1975

[21] Appl. No.: 545,615

[52] U.S. Cl. ..... 297/142; 297/241; 297/349

[51] Int. Cl.[2] ..... A47B 39/00

[58] Field of Search .....297/140–143, 14, 174, 240, 241, 349; 108/48

[56] References Cited

UNITED STATES PATENTS

| | | | |
|---|---|---|---|
| 1,772,581 | 8/1930 | Powers | 297/349 X |
| 2,024,045 | 12/1935 | Johnson | 297/142 |
| 2,245,951 | 6/1941 | Agee | 108/48 X |
| 2,306,812 | 12/1942 | Ketive | 297/142 |
| 2,992,743 | 7/1961 | Wing | 108/48 |
| 3,419,305 | 12/1968 | Baran | 297/349 X |

*Primary Examiner*—James C. Mitchell
*Attorney, Agent, or Firm*—Dana E. Keech

[57] ABSTRACT

A vertical tubular frame rigidly but detachably secured to the front wall of a bar at a right angle with said bar and extending out from under said bar at a suitable level to provide an arm rest for the occupant of a castersupported bar stool pivotally connected to the front vertical element of said frame on the axis of said element, with the back of said stool, when the latter is facing said bar, approximately parallel with and equidistant from the bar with said axis.

The stool is swingable solely about said axis between an inner position, where it thus faces said bar and an outer position where it faces at approximately a right angle to the bar, thereby facilitating a person entering or leaving the space between the bar and said stool. The radii on which the casters turn intersect said vertical axis of said front frame element so as to track with said stool when the latter is swung about said element. Said casters are also adjustable vertically to assure smooth operation of the stool.

12 Claims, 6 Drawing Figures

DUAL BAR STOOL SYSTEM

The invention is preferably manufactured in right and left hand forms to produce a dual bar stool system for occupancy by two individuals who prefer the intimate compartment set off by the outside arm rests of an adjacent right-and-left-hand pair of the bar stools of the invention.

SUMMARY OF THE INVENTION

It is a particular object of the present invention to provide a system for dividing the space along the front of a bar into a series of areas or compartments, each of which provides a pair of rigid arm rests at opposite ends of the area and a pair of side-by-side bar stools occupying the space between said arm rests, each stool being pivotally connected on a vertical axis with the front end of the rigid arm rest on its side of the compartment where the plane of the back of said stool intersects with said arm rest.

It is another object to provide such a series of dual bar stool compartments wherein each stool is free to swing about its captive axis between an inner position parallel with and facing the bar and an outer position facilitating a person entering or leaving the space between the bar and the stool and wherein each stool is spring loaded to return to said inner position when released.

A further object is to provide such a captive bar stool in which a retarding means is provided which inhibits the speed at which the stool returns in response to the spring loading means to said inner position.

Yet another object of the invention is to provide such a series of dual bar stood compartments in which the rigid arm rests are demountably secured to the structure of the associated bar and to the floor so as to be readily removeable therefrom whereby, with a minimum expense and trouble, said stools may be associated or disassociated with said bar structure.

DETAILED DESCRIPTION OF THE PREFERRED EMBODIMENT

Figure 1:
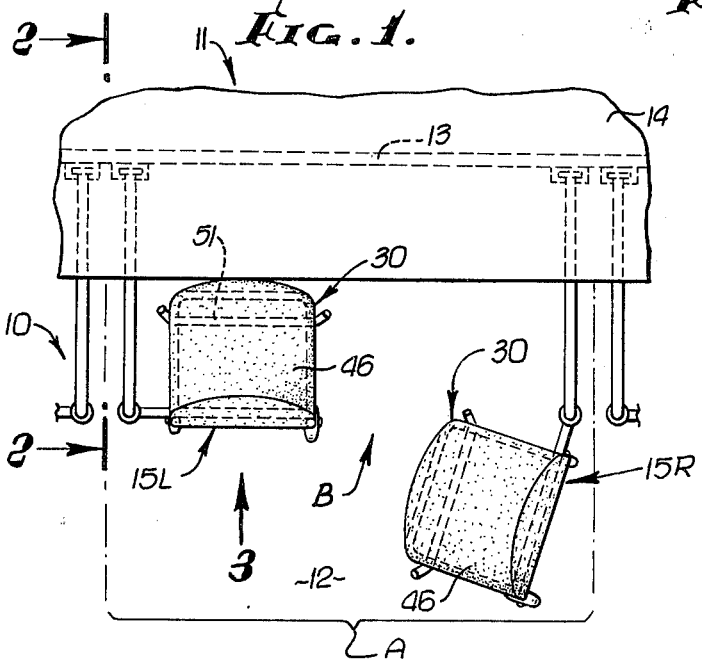
FIG. 1 is a diagrammatic plan view of a series of the dual bar stools of the invention associated with a conventional bar.
Figure 6:
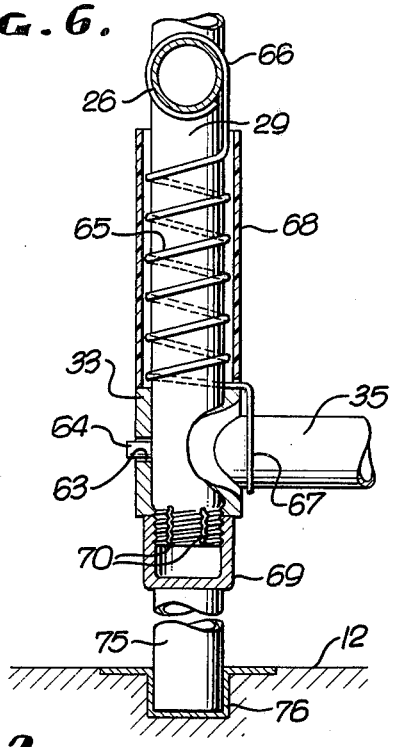
FIG. 6 is an enlarged detailed sectional view taken on the line 6—6 in FIG. 2 and illustrates the spring loading means of the invention.
Figure 2:
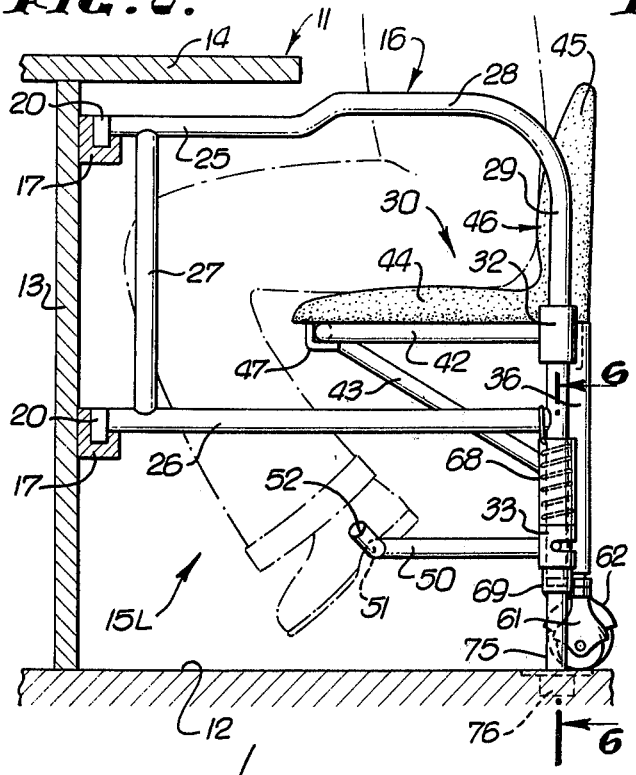
FIG. 2 is an enlarged cross sectional view taken on the line 2—2 of FIG. 1 and illustrates a person seated in a stool of the invention.
Figure 3:
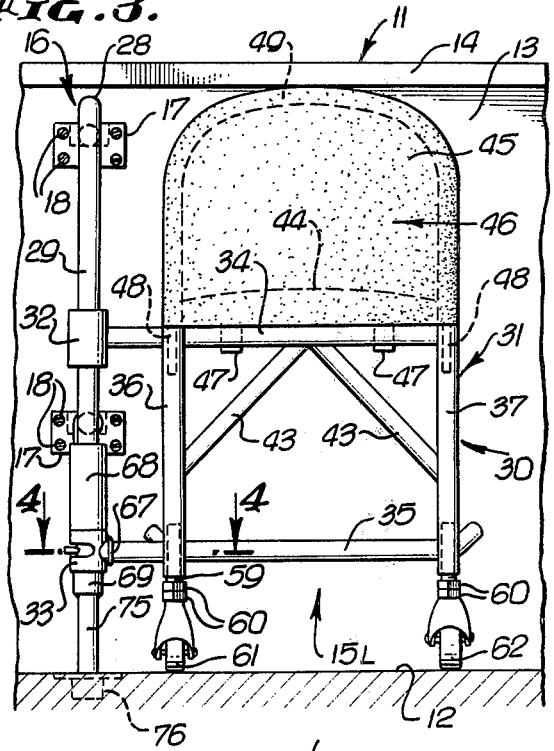
FIG. 3 is an enlarged front elevational view of the invention taken in the direction indicated by the arrow 3 in FIG. 1.
Figure 5:
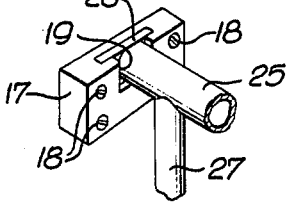
FIG. 5 is a fragmentary enlarged perspective view of the readily detachable means used in the invention for rigidly mounting the arm rests of the invention on a bar wall structure.
Figure 4:
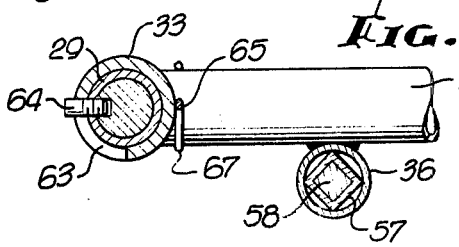
FIG. 4 is an enlarged fragmentary cross sectional view taken on the line 4—4 of FIG. 3.

The dual bar stool system 10 of the invention is provided to be associated with bars 11 of various lengths, each of which is conventionally mounted on a horizontal floor 12 and includes a wall 13 surmounted with a horizontal counter 14.

As before noted, the primary object of the invention is to cozily accommodate friendly couples seating themselves together for relaxation at the bar on a pair of closely adjacent stools in an area A set off from the rest of the bar.

Each of these areas A is thus set off from similar adjacent areas on either side thereof by mounting in said area two bar stool units 15, one of which is a left hand 15L and the other of which is a right hand unit 15R. A plan view of these two units mounted to set off an area A before bar 11 is illustrated in FIG. 1. Details of the structure of unit 15L are shown in FIGS. 2, 3, 4, 5 and 6. The distinctive characteristics in the structure of unit 15R will be pointed out following a detailed description of unit 15L.

Bar stool unit 15L occupies the left half of an area A and includes a vertical arm rest forming frame 16 and a pair of vertically aligned brackets 17 which are fixed to wall 13 by screws 18 and have non-circular vertical socket recesses 19 for receiving correspondingly shaped lugs 20 of said frame 16 to rigidly but detachably support the latter on said wall.

The frame 16 is preferably formed of one inch metal tubing, is approximately rectangular in shape and includes top and bottom horizontal members 25 and 26, and a vertical spacer member 27 which is butt welded to inner ends of members 25 and 26 on which lugs 20 are welded. Top members 25, when said frame is mounted on brackets 17 is spaced downwardly from counter 14 just far enough to assure upward withdrawal of lugs 20 from brackets 17 when frame 16 is lifted. A portion of member 25 disposed outwardly from under bar counter 14 is bent upwardly and horizontally to form an arm rest 28 which then curves downwardly at its outer end to form vertical frame shaft member 29 to which the outer end of frame horizontal member 26 is butt welded at a point a substantial distance above the lower end of member 29.

Bar stool unit 15L also includes a bar stool 30 having a back frame 31 which includes upper and lower spaced bearings 32 and 33 rotatably assembled on shaft member 29. Back frame 31 is preferably made of metal tubes of one inch diameter welded together including horizontal members 34 and 35 corresponding ends of which are butt welded respectively to bearings 32 and 33, and vertical members 36 and 37 which are welded to rear faces of members 34 and 35 in crossed relation therewith to form a rectangle. Upper ends of members 36 and 37 are flush with member 34 while lower ends of members 36 and 37 extend below member 35. A perimetric U-shaped rod 42 forming a horizontal seat supporting base is butt welded at its ends to upper horizontal back frame member 34 so as to be flush with the latter. Brace rods 43 extend from a mid point in seat base 42 to mid points in vertical back frame members 36 and 37 and are welded in place.

An upholstered seat 44 and back 45 combined as a unit 46 is detachably mounted on back frame 31 by the use of hooks 47 which hook around seat back rod 42 and pins 48 which fit down snugly in upper ends of vertical back frame tubular members 36 and 37. Seat-back unit 46 is built upon a tubular metal frame 49 giving the unit rigidity and to which hooks 47 and pins 48 are welded.

A U-shaped rod 50 is butt welded at its open ends to a front face of horizontal frame member 35 and extends horizontally therefrom to provide a foot resting rail 51 having foot confining horns 52 at its opposite ends.

Lower end portions of vertical back frame tubular members 36 and 37 have square tubular sleeves 57 driven thereinto to slideably receive square shanks 58 formed on upper ends of threaded stems 59 carrying adjustable lock nuts 60 and on lower ends of which are mounted caster wheels 61 and 62 for supporting bar stool 30 on the floor 12. The nuts 60 provide vertical adjustment of the level at which the caster wheels support said stool so as to relieve arm rest frame 16 of having to bear this burden. The square sleeves 57 and shanks 58 prevent rotation of threaded stems 59 whereby caster wheels 61 and 62 always rotate on radii intersecting the axis of bearings 32 and 33 so as to freely track with bar stool 30 whenever the latter is swung about said axis.

To limit said swinging movement of bar stool 30 to an inward, normal position where the stool directly faces bar 11 and an outwardly swung position such as required for a guest conveniently occupying or retiring from the occupancy of said stool, bearing 33 is provided with a radial slot 63 having approximately a 100° angle and slideably accommodating a stop pin 64 mounted rigidly on tubular shaft member 29.

To return bar stool 30 to its normal position whenever it is released, while swung outwardly therefrom, a shaft member 29 has coiled thereabout a wire spring 65, an upper end 66 of which is hooked about lower horizontal frame member 26 and the lower end 67 of which is hooked about lower horizontal stool back frame member 35. Spring 65 may be covered by a metal or plastic sleeve 68.

A screw cap 69 is applied to threads provided on the lower end portion of shaft frame member 29 and radial ducts 70 are provided in member 29 at the upper edge of cap 69 for draining into said cap lubricant escaping downwardly from bearing 33. The lubricant applied to said bearing, and optionally also to bearing 32, preferably is silicon and the tolerance allowed between said bearings and said shaft member is related to the torque applied by spring 65, tending to return bar stool 30 rapidly to its normal position, so as to effectively prevent said return being too rapid but assuring a suitable regulated gentle rate of return.

This concludes the detailed description of bar stool unit 15L. The structure of complementary bar stool unit 15R, one of which is installed in the right half of each bar area A, is identical with that of unit 15L with the exception that the arm rest forming frame 16 thereof is located on the right hand side of the bar stool 30 of that unit instead of on the left side thereof as is the case in each unit 15L. The stool 30 of each of the two units grouped together in a bar area A thus opens and closes towards the corresponding stool of the other unit. Moreover, the outside location of the arm rest forming frames 16 of the two units in the area tends to set off the area and thereby emphasize a degree of intimacy and privacy which is not enjoyed by a couple merely occupying an adjoining pair of bar stools as conventionally provided at bars generally.

The invention further provides for each individual of the couple occupying an area A of the system 10 thereof, an arm rest at the adjacent side boundary of the area and a personal foot rail 51 mounted integral with the stool 30 on which he is seated, said rail moving with said stool in a uniform relation therewith as the stool is swung into or away from its normal inward position facing bar 11.

As also illustrated in FIG. 1, it is only necessary for one member of a couple to swing his selected one of the dual bar stools 30 to its outward position (against the resistance of its spring 65 and its silicon retarding means) to open a passageway B freely admitting the other member of the couple to seat himself or herself, as the case might be, in the other bar stool 30 by slipping sideways into the latter while this remains in its inward position. The individual who had swung his selected stool 30 outward is thereupon free to seat himself thereon, place his feet on his individual foot rail and assist, if he so desires, the inward swinging of his stool 30 by applying a hand to the arm rest 28 about which that stool pivots.

Should either individual of a couple seated together at bar 11 in an Area A of the invention desire to leave said area, for any reason, without disturbing his or her companion, this is easily accomplished by pushing against the bar 11 to swing the bar stool 30 occupied by this individual to its outward position. This produces a free passageway B allowing a ready exit by said individual from said area.

Should a gentlemen wish to be more meticulous in observing the amenities of seating his lady friend, he could, of course, invite her to seat herself in the bar stool 30 selectively swung outward by him, then assist in swinging her stool inward, and, thereafter, swing the other bar stool 30 outward and seat himself thereon.

While mention is made above of assistance being given return of a bar stool 30 to inward position with a person seated thereon, each spring 65 is preferably selected to accomplish such a return of the stool, thus occupied, at a satisfactory retarded rate, and without requiring manual assistance.

In summing up the advantages of the invention, mention should also be made of the facility provided therein for assembling a series of pairs of units 15L and 15R in association with bar 11 or detaching said units for storage or seasonal servicing or for any other reason. Such detachment of said units is readily accomplished by lifting on the frames 16 close to the spacer members 27 so as to retract lugs 20 from brackets 17.

While the cap 69 is provided to capture drippings of lubricant from bearing 33, it also optionally embodies a downward extension 75 of shaft member 29 which is of a suitable length to extend into a socket 76, countersunk in the floor 12, when the lugs 20 are lowered into the bar brackets 17. The frame 16 is thus rigidly supported at three points, and, when this option is exercised, the caster wheel 61 may be omitted, if desired.

The claims are:

1. In a device for effecting a tethered association of a bar stool with a bar structure embracing a bar wall capped by a bar counter, and resting on a floor, the combination of:

a frame fixed on and releasably interlocking with said bar structure and rigidly held thereby in a vertical plane at a right angle with and extending a substantial distance outwardly from beneath said bar counter, a front element of said frame comprising a vertical shaft;

vertically aligned bearing means rotatably mounted on said shaft; and a bar stool, when normally in use, squarely facing said bar, said stool being disposed to one side of said frame and rigidly mounted at its backside on said bearing means to swing about the axis thereof, said axis lying approximately in the plane of the backside of said stool at all times, said stool being exclusively rotatable about said axis in swinging said stool between said normal position and an outward position allowing for movement of a person either into or away from the occupancy of said stool.

2. A combination as recited in claim 1 wherein said devices are made in left hand and right hand units and the space before said bar is divided into dual unit compartments each of which is occupied by a right hand unit on the right and a left hand unit on the left and with the respective vertical frames of said units located at the opposite ends of said compartment and comprising arm rests for the occupants of the compartment.

3. A combination as recited in claim 1 wherein:

said bar stool has a rectangular back frame lying in a vertical plane in the backside of said stool and disposed at all times approximately radially with respect to said bearing axis about which said stool swings;

caster wheel means provided to extend downwardly from said stool back frame into stool-supporting contact with said floor, said wheel means rotating on a radius from said stool axis when said stool is swung about the latter; and means at the front edge of said frame providing a floor socket for releasably interlocking with a downward extension from said frame.

4. A combination as recited in claim 3 wherein foot rail means is provided cantilever fashion on said bar stool back frame and is thus supported under said stool and above said floor for use as a foot rail by an occupant of said stool.

5. A combination as recited in claim 3 wherein stop means is provided to limit the swinging of said bar stool about said bearing axis to the normal and outward positions of said stool aforementioned; and spring loaded means automatically returning said bar stool to its normal position upon said stool being released.

6. A combination as recited in claim 5 wherein a retarding means is provided for restraining the action of said spring loaded means in returning said bar stool to normal position.

7. A combination as recited in claim 1 wherein bracket means is provided on said bar wall; and readily detachable means is provided for interengaging said frame with said bracket means to rigidly mount said frame thereon, said detachable means being readily disconnected by an upward shift of said frame thus freeing said frame and bar stool for removal for servicing or storage.

8. A combination as recited in claim 7 wherein said bracket means comprise vertical sockets with non-circular vertical recesses and are adapted for being rigidly secured in vertical alignment to the bar wall, and wherein said frame is approximately rectangular and formed of tubing and has vertically aligned lugs at its inner upper and lower corners shaped to be snugly received in said bracket recesses to rigidly interlock said frame with said bracket means, said upper tubular frame member being spaced downwardly from said bar counter when said frame is installed in said bracket means to give room for lifting said frame to free the latter from said bracket means; and an arm rest formed by an upward bend in that portion of said upper tubular frame member which extends outwardly from under said bar counter.

9. A combination as recited in claim 3 wherein said back frame of said stool includes two spaced vertical tubular members, two spaced horizontal tubular members contacting and welded to said vertical members and extending beyond said frame into abutment with said bearings to which they are welded, said bar stool also including a horizontal perimetral seat frame abutting against and welded to the upper of said back frame horizontal members, oblique braces welded at their ends to a central point in said seat frame and to mid points in said back frame side members; and an upholstered combination seta-and-back for said stool resting on and supported by said perimetral seat frame, said seat-and-back having hook means fitting over said seat frame and vertical pins fitting downwardly into upper ends of said vertical back frame tubular elements to retain said seat-and-back in place on said seat frame.

10. A combination as recited in claim 7 wherein the front edge portion of said frame embodies a vertical shaft on which said vertical aligned bearing means rotate; and floor mounted socket means aligned with said shaft for receiving a lower end portion of said shaft when said frame is lowered to interengage with said bracket means, said socket means and bracket means thereby uniting to rigidly support said frame.

11. In a dual bar stool system the combination of:

dual parallel vertical frame means spaced apart at right angles with a bar and marking the ends of a compartment or free space located under and in front of said bar for accommodating a pair of bar stools and persons occupying said stools;

a pair of arm rests on said frame means, one at each end of said compartment, said arm rests extending from said bar to the front ends of said frame means;

rotatable-stool-mounting vertical bearing means provided respectively on said frame means beneath the front ends of said arm rests;

a pair of stools, one right handed and one left handed, said stools having backs normally disposed parallel with said bar, and, when so disposed, lying approximately in the same plane as the axes of said bearing means; and means rigidly connecting said stools respectively to the bearing means closest thereto whereby each stool is exclusively rotatable, as an entirety, about the axis of the bearing means to which it is affixed.

12. In a dual bar stool system, the combination of:

frame means subdividing the lengthwise area in front of and beneath a bar into an end-to-end series of dual bar stool accommodating compartments, said frame means providing arm rests at the opposite ends of each compartment alongside the area of said compartment in front of said bar;

rotatable vertical stool mounting bearing means provided on said frame means and located beneath the front ends of said arm rests;

plural sets of stools, a right handed stool and a left handed stool in each set, one set being provided for each compartment, said stools having back normally disposed parallel with said bar and lying, when so disposed, approximately in the same plane as the axes of said bearing means; and means rigidly connecting said stools to the bearing means on the frame means closest to said stools respectively, whereby each of said stools is free to be swung individually outwardly away from alignment with the other stool to facilitate use of one of a pair of stools without disturbing an occupant of the other stool.

* * * * *